United States Patent [19]

Smithson et al.

[11] Patent Number: 4,865,351

[45] Date of Patent: Sep. 12, 1989

[54] PHOTO CHEQUE

[76] Inventors: Harry A. Smithson, 1005 Terrace St., Seattle, Wash. 98104; George Spector, 233 Broadway, Rm 3815, New York, N.Y. 10007

[21] Appl. No.: 231,256

[22] Filed: Aug. 11, 1988

[51] Int. Cl.[4] ..... B42D 15/00

[52] U.S. Cl. ..... 283/58; 283/77; 283/81; 283/56; 283/117

[58] Field of Search ..... 283/58, 77, 81, 56, 283/117

[56] References Cited

U.S. PATENT DOCUMENTS 3,258,277 6/1966 Schuster ..... 283/58 X
3,671,059 6/1972 Zeller ..... 283/58 X

FOREIGN PATENT DOCUMENTS 1161610 9/1958 France ..... 283/58

*Primary Examiner*—Paul A. Bell

[57] ABSTRACT

A photo check is provided in which a photograph of a person is disposed upon a check to make quick identification of the person authorized to sign the check. A photograph dispensing device is also provided for adhering a photograph of the person onto the check.

2 Claims, 1 Drawing Sheet

PHOTO CHEQUE

BACKGROUND OF THE INVENTION

The instant invention relates generally to identification devices and more specifically it relates to a photo check, credit card etc.

Numerous identification devices have been provided in prior art that are adapted to contain a photograph of a person. For example, U.S. Pat. Nos. 3,258,277; 3,671,059 and 3,896,726 all are illustrative of such prior art. While these units may be suitable for the particular purpose to which they address, they would not be as suitable for the purposes of the present invention as heretofore described.

SUMMARY OF THE INVENTION

A primary object of the present invention is to provide a photo check that will overcome the shortcomings of the prior art devices.

Another object is to provide photo check in which a photograph of a person is disposed upon a check to make quick identification of that person.

An additional object is to provide a photo check that includes a photograph dispensing device for placing a photograph of a person onto their check for identification thereof.

A further object is to provide a photo check that is simple and easy to use.

A still further object is to provide a photo check that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
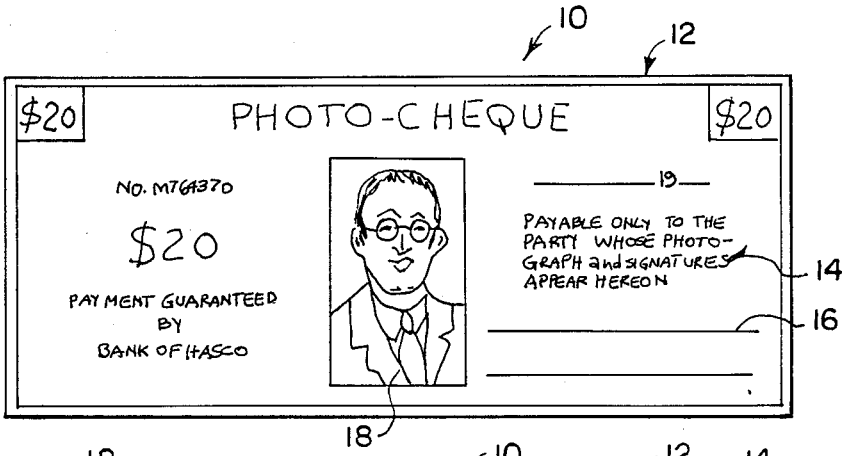
FIG. 1 is a top plan view of the invention as a bank check with a photograph thereon.
Figure 2:
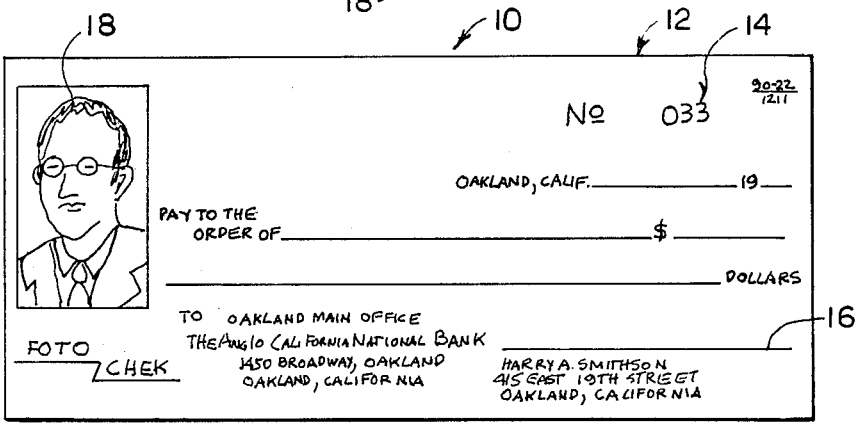
FIG. 2 is a top plan view of the invention as a personal check with a photograph thereon.

Turning now descriptively to the drawings, in which similar reference characters denote similar elements throughout the several views, FIGS. 1 and 2 illustrates a photo check 10 consisting of a blank negotiable check 12 that has indicia 14 printed thereon in a check form that includes a signature line 16 of a person authorized to sign the check 12. A photograph 18 is disposed thereon of the person authorized to sign the negotiable check 12 so as to make a quick identification possible of that person.

In FIG. 1 the indicia 14 on the blank negotiable check 12 is in the form of a bank check which allows the person who's photograph 18 and signature on the signature line 16 to only cash the check 12. In FIG. 2 the indicia 14 on the blank negotiable check 12 is in the form of a person check which allows the person who's photograph and signature on the signature line 16 is issue the check 12.

Figure 3:
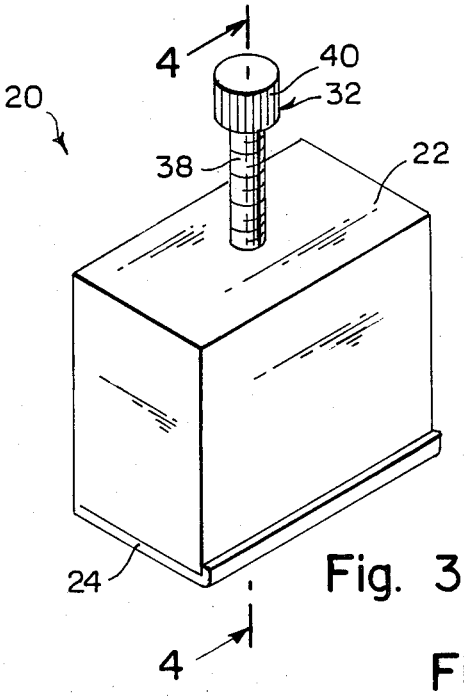
FIG. 3 is a perspective view of a photograph dispensing device for placing a photograph onto the check.
Figure 4:
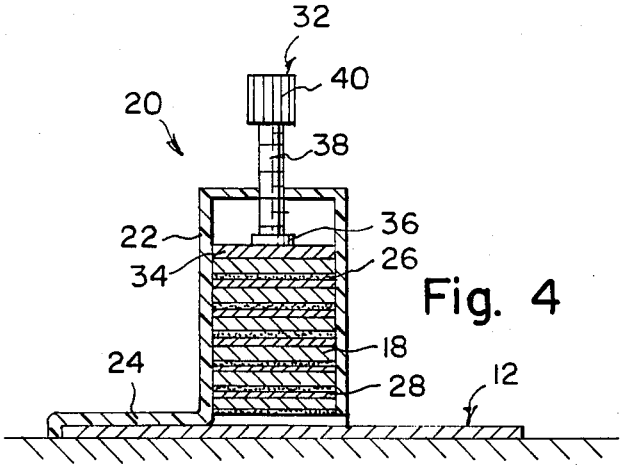
FIG. 4 is a cross sectional view taken along line 4—4 in FIG. 3 with bottom cover opened and device placed onto the check.
Figure 5:
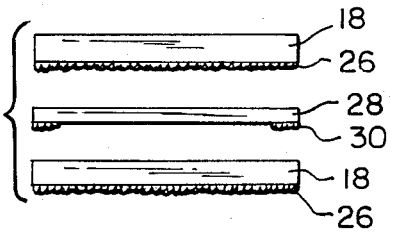
FIG. 5 is an exploded side view of two of the photographs and backing sheet inbetween that is located within the dispensing device.

FIGS. 3 and 4 show a photograph dispensing device 20 for placing the photograph 18 onto the check 12 and includes a housing 22 that has a pivotable bottom cover 24. A plurality of photographs 18 of the person are provided. Each of the photographs 18 has adhesive 26 on bottom surface thereof (see FIG. 5) and stored within the housing 22. A plurality of backing sheets 28 are also provided. Each of the sheets 28 is stored within the housing 22 between two of the photographs 18. Each of the sheets has a small amount of adhesive 30 on bottom surface thereof to slightly stick to the photograph 18 underneath the sheet 28 (see FIG. 5). A structure 32 is for applying one of the photographs 18 from the housing 22 onto the check 12 when the bottom cover 24 is in an open position and the housing 22 is placed upon face of the check 12.

The photograph applying structure 32 includes a plate 34 that has a top collar 36 thereon. The plate 34 is placed within the housing 22 to bear against the top photograph 18. A threaded shaft 38 is swiveled to the top collar 36 of the plate 34 and threadably extends upwardly out of the housing 22. A knob 40 is affixed to distal end of the threaded shaft 38 whereby turning of the knob 40 on the shaft 38 will cause the plate 34 to travel down and press against the top photograph 18. The adhesive 26 on the bottom photograph 18 will stick to the check 12 allowing the bottom photograph 18 to pull away from the bottom backing sheet 28 which can then be peeled off from the next bottom photograph 18 so that the cycle can be repeated.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention. For example a similar process can be adapted in regard to providing a credit card with a photo.

What is claimed is:

1. A photo check which comprises:

(a) a blank negotiable check having indicia printed thereon in a check form including a signature line of a person authorized to sign said check; and (b) a photograph disposed thereon of the person authorized to sign said negotiable check so as to make a quick identification possible of that person, further comprising a photograph dispensing device for placing said photograph onto said check which comprises:

(c) a housing having a pivotable bottom cover;

(d) a plurality of photographs of the person each of said photographs having adhesive on bottom surface thereof and stored within said housing;

(e) a plurality of backing sheets, each of said sheets stored within said housing between two of said photographs, each of said sheets having a small amount of adhesive on bottom surface thereof to slightly stick to said photograph underneath said sheet; and (f) means for applying one of said photographs from said housing onto said check when the bottom cover is in an open position and said housing is placed upon face of said check.

2. A photo check as recited in claim 1 wherein said photograph applying means includes:

(g) a plate having a top collar thereon, said plate placed within said housing to bear against said top photograph;

(h) a threaded shaft swiveled to the top collar of said plate and threadably extending upwardly out of said housing; and (i) a knob affixed to distal end of said threaded shaft whereby turning of said knob on said shaft will cause said plate to travel down and press against said top photograph so that the adhesive on said bottom photograph will stick to said check allowing said bottom photograph toppull away from said next bottom photograph so that the cycle can be repeated.

* * * * *